US007523833B2

(12) United States Patent
Zipeto et al.

(10) Patent No.: US 7,523,833 B2
(45) Date of Patent: Apr. 28, 2009

(54) ROTARY SHOE STORAGE DEVICE

(76) Inventors: Kenneth M. Zipeto, 1616 Surrey La., Havertown, PA (US) 19083; Jennifer S. Zipeto, 1616 Surrey La., Havertown, PA (US) 19083

( * ) Notice: Subject to any disclaimer, the term of this patent is extended or adjusted under 35 U.S.C. 154(b) by 346 days.

(21) Appl. No.: 11/147,673

(22) Filed: Jun. 8, 2005

(65) Prior Publication Data

US 2006/0278592 A1 Dec. 14, 2006

(51) Int. Cl.
*A47G 29/00* (2006.01)

(52) U.S. Cl. ..... 211/78; 211/36; 211/144

(58) Field of Classification Search ..... 211/78, 211/70, 163, 34, 36, 144, 187, 189, 207, 211/195, 205, 184; 108/59, 94, 95, 147.11, 108/144.11

See application file for complete search history.

(56) References Cited

U.S. PATENT DOCUMENTS

| | | | | | |
|---|---|---|---|---|---|
| 574,482 | A | * | 1/1897 | Hastings | 108/60 |
| 2,081,856 | A | * | 5/1937 | Frick | 211/131.1 |
| 2,082,088 | A | | 6/1937 | Wilson | |
| 2,541,048 | A | | 2/1951 | Goodsman | |
| 2,750,051 | A | * | 6/1956 | Wassell | 108/103 |
| 3,056,506 | A | * | 10/1962 | Fuller et al. | 211/1.55 |
| 3,478,890 | A | | 11/1969 | Allsop | |
| 3,596,077 | A | | 7/1971 | Miaza | |
| 4,453,326 | A | * | 6/1984 | Hoffman et al. | 40/377 |
| 4,549,664 | A | * | 10/1985 | Gowan et al. | 211/131.1 |
| 4,838,625 | A | * | 6/1989 | Taylor | 312/249.5 |
| 5,031,779 | A | * | 7/1991 | Szenay et al. | 211/40 |
| 5,033,627 | A | | 7/1991 | Brown | |
| 5,050,746 | A | | 9/1991 | Frankel | |
| 5,524,775 | A | * | 6/1996 | Kaine | 211/131.1 |
| 6,189,710 | B1 | * | 2/2001 | Mason | 211/131.1 |
| 6,206,493 | B1 | * | 3/2001 | Sanchez-Levin et al. | 312/155 |
| 6,502,707 | B1 | * | 1/2003 | Sullivan | 211/163 |
| 6,585,119 | B2 | * | 7/2003 | Palder | 211/49.1 |
| 6,631,804 | B2 | * | 10/2003 | Wong | 206/526 |
| 2004/0104188 | A1 | * | 6/2004 | Russell et al. | 211/78 |
| 2006/0169653 | A1 | * | 8/2006 | Palder et al. | 211/49.1 |

* cited by examiner

*Primary Examiner*—Jennifer E. Novosad
(74) *Attorney, Agent, or Firm*—James Ray & Assoc

(57) ABSTRACT

A rotary shoe storage device includes a base member and a pivot extending outwardly from and attached to the base member. A shelf for supporting shoes has an inclined surface and a hub connected to and extending outwardly from the shelf. The hub is provided with an aperture for engaging the pivot thus enabling pivoting of the shelf about the base member. The hub is further provided with a plurality of surface slots for receiving partitions which divide the shelf into adjustable compartments to accommodate various shoe sizes. The shelf is provided with a peripheral flange to generally confine the shoes within each compartment. The device can be placed beneath a conventional bed or mounted to an underside of the bed. The shelf can be provided with a clamp for mounting to a vertically disposed shaft of a rotary shoe rack.

13 Claims, 1 Drawing Sheet

ROTARY SHOE STORAGE DEVICE

FIELD OF THE INVENTION

The present invention relates, in general, to a rotary tray or rack and, more particularly, this invention relates to a rotary tray or rack for storing shoes beneath a conventional frame bed or in a wardrobe closet.

BACKGROUND OF THE INVENTION

As is generally well known, shoes are commonly stored either directly on the floor of the wardrobe closet beneath hanging clothing and other household belongings or in shelf-like shoe racks which are generally placed along the rear wall of such wardrobe closet. Placement of shoes directly on the floor limits the quantity of shoes stored in the closet, wastes the closet space above the shoes beneath the hanging clothing and necessitates undesirable bending in order to retrieve them. Shelf-like shoe racks are typically limited in depth resulting in wasted closet space or obstructed view of shoes stored on the lower shelf.

Some people prefer to store the shoes beneath a conventional frame bed but are limited to placing shoes in a single row in order to easily locate and retrieve a desirable pair of shoes. Additionally, cleaning of the floor space beneath the bed requires each pair of shoes to be relocated individually.

Attempts have been made to improve shoe storage either in the closet or beneath the bed.

U.S. Pat. No. 5,050,746 to Frankel illustrates a rotary shoe rack having a shaft mounted to fixed lower and upper surfaces and a plurality of storage shelves secured to the shaft at spaced intervals. Each shelf is provided with a heel support attached to the shelf surface adjacent the shaft and adapted with a plurality of bushings to hold each shoe fairly securely in place on or against the rail and organize storage of each shoe on the shelf surface. However, the disadvantages of such a shoe rack are in their fixed mounting, in complexity of the heel support and in wasted shelf space due to use of the bushing to govern heel placement in order to organize shoes.

U.S. Pat. No. 3,596,077 to Miazga illustrates a rotary support or rack mounted to the underside of the bed and having planar lower and upper surfaces and spaced partitions for slidably holding shoe drawers. The use of drawers prevents ease of visually locating a particular pair of shoes.

U.S. Pat. No. 2,082,088 to Wilson teaches a device of turntable construction with fixed dividers formed by a crimping method for organizing shoe storage which can be placed on the floor surface beneath the bed or be mounted to the underside of the bed. Such fixed compartment configuration limits the quantity and sizes of stored shoes.

Therefore, there is a need for an improved shoe storage device which maximizes usable storage space and enables ease of visual shoe identification.

SUMMARY OF THE INVENTION

The invention provides a rotary shoe storage device for placement beneath a conventional bed or onto a closet floor. Such device includes a base member and a pivot extending outwardly from and attached to the base member. A shelf for supporting shoes has an inclined surface and a hub connected to and extending outwardly from the shelf. The hub is provided with an aperture for engaging the pivot thus enabling pivoting of the shelf about the base member. Alternatively, the attachment of pivot and hub may be reversed. The hub is further provided with a plurality of surface slots for receiving a first edge of partitions which divide the shelf into adjustable compartments to accommodate various shoe sizes. The shelf is provided with a peripheral flange to generally confine the shoes within each compartment. Such peripheral flange may be provided with a plurality of second slots for receiving a second end of each partition. The device may be provided with a lid and the shelf may be provided with a second flange engaging an outer edge of such lid for stacking such devices. Furthermore, the shelf can be provided with a clamp for mounting to a vertically disposed shaft of a shoe rack.

OBJECTS OF THE INVENTION

It is, therefore, one of the primary objects of the present invention to provide a rotary device for storing shoes.

Another object of the present invention is to provide a rotary shoe storage device which is adjustable to accommodate various size shoes.

Yet another object of the present invention is to provide a rotary shoe storage device which is adjustable to accommodate various numbers of shoes.

A further object of the present invention is to provide a rotary shoe storage device which is economical to manufacture.

Yet a further object of the present invention is to provide a rotary shoe storage device which permits ease of visual identification of shoes.

An additional object of the present invention is to provide a rotary shoe storage device which allows efficient use of storage space.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
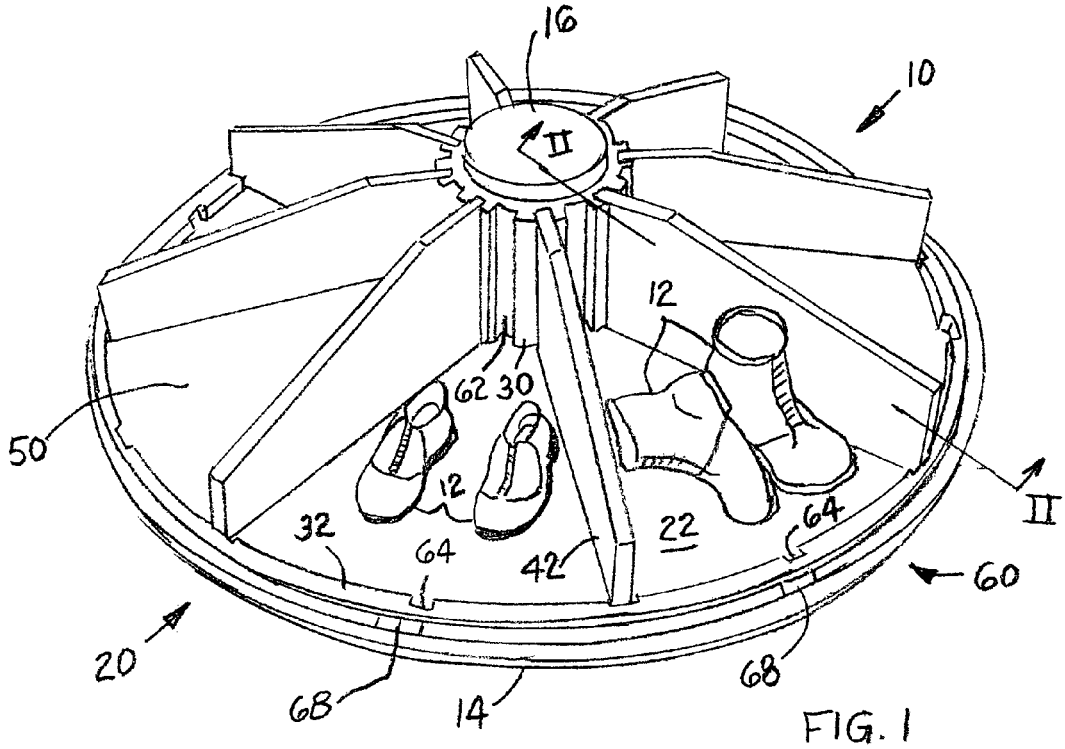
FIG. 1 is a perspective view of a rotary shoe storage device of a presently preferred embodiment of the invention.

Prior to proceeding to the more detailed description of the present invention, it should be noted that, for the sake of clarity and understanding, identical components which have identical functions have been identified with identical reference numerals throughout the several views illustrated in the drawing figures.

Figure 2:
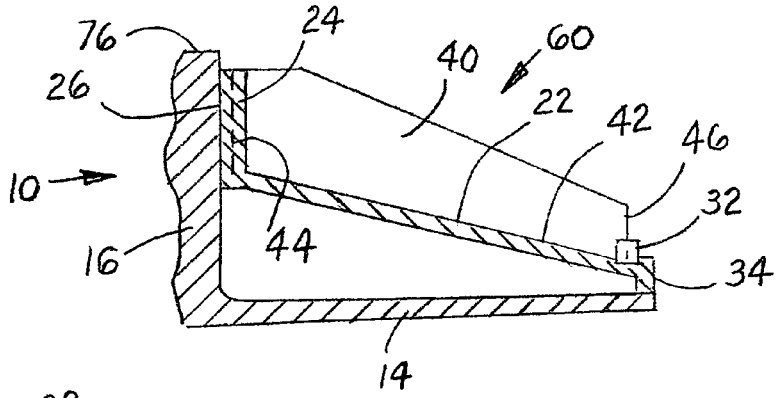
FIG. 2 is a partial cross-sectional view of the present invention taken along lines 2-2 of FIG. 1.
Figure 3:
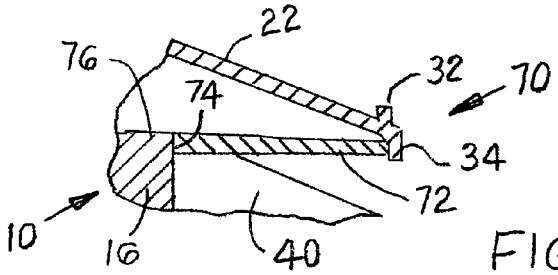
FIG. 3 is a partial cross-sectional view of the present invention, particularly showing a stacking arrangement of the presently preferred embodiment.

Reference is now made, to FIGS. 1-3, wherein there is shown a rotary device, generally designated 10, for storing shoes 12. Such rotary shoe storage device 10 includes a base means 14 having each of a predetermined size and a predetermined shape. A pivot means 16 extends outwardly from and is attached to the base means 14. Preferably, base means 14 and pivot means 16 are formed as an integral single piece unit. While a substantially planar configuration of the base means is illustrated, it will be understood that other configurations of such base means 14 may be applied for placing the rotary shoe storage device 10 onto a surface.

A shoe support means, generally designated 20, includes a surface portion 22 having each of a predetermined size and a predetermined shape and which is, preferably, disposed at a predetermined angle about a peripheral edge thereof. The preferred predetermined shape of the surface portion 22 is round. A hub 24 is connected to and extends outwardly from the surface portion 22 of the shoe support means 20 for a predetermined length. The hub 24 includes an aperture 26 axially disposed therein for engaging the pivot means 16 enabling pivoting of the shoe support means 20.

The shoe support means 20 may be further provided, at least partially, with a peripheral flange 32 extending outwardly from the peripheral edge of the surface portion 22. Such peripheral flange 32, typically integral with the surface portion 22 is advantageous in grasping the rotary shoe storage device 10 during use and to generally confine the shoes 12 within the shoe support means 20.

The rotary shoe storage device 10 further includes at least one partition 40 having a first edge 42 engaging the surface portion of the shoe support means and having a second edge 44 engaging the outer surface 30 of the hub 24, whereby the at least one partition 40 outwardly extends from the surface portion 22 of the shoe support means 20.

Preferably, a plurality of such partitions 40 are employed in the present invention, with each pair of adjacently disposed partitions 40 forming a compartment 50 for storing shoes 12.

To releaseably secure such at least one partition 40 to a shoe support means 20, the rotary shoe storage device 10 is provided with securing means, generally designated 60, which in the presently preferred embodiment includes a predetermined plurality of partition retaining means 62 disposed in a predetermined pattern in the outer surface 30 of the hub 24. Each of the partition retaining means 62 is preferably a slot having each of a predetermined width and a predetermined depth.

Preferably, the peripheral flange 32 is adapted with a predetermined plurality of second partition retaining means 64, each aligned with a respective one of the predetermined plurality of retaining means 62 disposed in the outer surface 30 of the hub 24 for securely receiving a third edge 46 of the at least one partition 40. Each second partition retaining means 64 is a slot having each of a predetermined width and a predetermined depth substantially identical to those of the slot 62 disposed in the outer portion 30 of the hub 24.

In operation, use of the predetermined plurality of slots 62 enables one to individually adjust the size of each compartment 50 and, more particularly, enables the rotary shoe storage device 10 to accommodate various sizes of shoes 12. The open configuration of each compartment 50 adjacent the peripheral edge of the shoe support means 20 enables ease of visual identification and retrieval of a particular pair of shoes 12.

The rotary shoe storage device 10 may be manufactured from a variety of materials including but not limited to plastic, metallic, wood and paper. The preferred material is plastic which enables economically manufacture of each component of such rotary shoe storage device 10 and reduce the effort required to assemble such rotary shoe storage device 10.

It will be understood that at least the shoe support means 20 will have a predetermined color and that the base means 14 may be provided with a second predetermined color which may be identical to the predetermined color of the shoe support means 20.

In further reference to FIG. 1, a plurality of labels 68, preferably attached to the peripheral flange 32, may be provided for designating each compartment 50 to hold a particular pair of shoes 12 further aiding in organization of shoe storage.

In particular reference to FIGS. 2 and 3, the rotary shoe storage device 10 may include means, generally designated 70, disposed therein for securely stacking at least a pair of the rotary shoe storage devices 10. In the presently preferred embodiment, such stacking means 70 includes a lid member 72 having an aperture 74 engageable with a protruding end 76 of the pivot means 16, such lid member further engageable with a portion of the at least one partition 40, and a second peripheral flange 34 connected to and extending outwardly from the peripheral edge of said surface portion 22 of said shoe support means 20, wherein the second peripheral flange 34 engages an outer edge of the lid member 72 during stacking at least a pair of the rotary shoe storage devices 10.

Alternatively, such stacking means 70 may be provided by simple engagement of the second flange 34 with the outer edge of the lid member 72. Alternatively, a plurality of apertures (not shown) may be provided in the base means 14 to engage raised portions (not shown) of the at least one partition 40.

Although the present invention has been shown in terms of the rotary shoe storage device 10 adapted for placement on a surface such as beneath the bed or in the wardrobe closet, it will be apparent to those skilled in the art, that the present invention may be adapted for mounting on the underside of a bed frame by any conventional means in one of a slidable and nonslideable condition.

Furthermore, the shoe support means 20 may be adapted for use on a rotary rack for a storage space having generally fixed upper and lower surfaces, the rack including a shaft that extends generally vertically between the upper and lower surfaces, upper and lower bearing means for rotatably mounting upper and lower ends of the shaft, respectively, to such upper and lower surfaces. In such applications, the shoe support means 20 will be provided with any well known clamp means disposed in the hub 24 or attached to the surface portion 22 for clamping such surface portion 22 to a predetermined portion of such shaft.

Additionally, it will be understood that other conventional retaining means may be applied to secure the at least one partition 40 to the shoe support means 20. For example, the hub 24 may be provided with a plurality of apertures disposed in a predetermined pattern, each adapted for securely receiving a simple support means, with a pair of such adjacently disposed support means forming a passage for receiving the second edge 44 of the at least one partition 40. Or, the at least one partition 40 may be provided with pin like members outwardly extending from at least one edge thereof for engagement with apertures or cavities disposed in the hub 24 and the surface portion 22.

The attachment of the pivot means 16 and the hub 24 may be reversed, in which case the pivot means 16 will be adapted with partition retaining means 62.

Furthermore, although the present invention has been shown in terms of the rotary storage device 10 provided for storing shoes it will be apparent to those skilled in the relevant art, that the present invention may be applied to storing other elements, for example, such as household products.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

We claim:

1. A rotary storage device comprising:

(a) a base having each of a predetermined size and a predetermined shape;

(b) a support including each of a surface portion having each of a predetermined size and a predetermined shape, a first peripheral flange disposed on and secured to a peripheral edge of said surface portion and extending downwardly therefrom when said device is in use, and a second peripheral flange connected to and extending upwardly from said peripheral edge of said surface portion of said support;

(c) a pivot extending outwardly from and attached to one of said base and said surface portion of said support;

(d) a hub connected to and extending outwardly from an opposed one of said base and said surface portion of said support for a predetermined length, said hub having an aperture axially disposed therein for engaging said pivot, whereby said support is pivotable about said base; and (e) at least one partition and a partition retaining means engaging one of said surface portion of said support, said hub, said pivot and various combinations thereof releaseably securing said at least one partition on said surface portion.

2. The device, according to claim 1, wherein said partition retaining means is a predetermined plurality of slots disposed in a predetermined pattern in an outer surface of said hub, each of said predetermined plurality of slots having each of a predetermined width and a predetermined depth.

3. The device, according to claim 2, wherein said device further includes said at least one partition having a first edge engaging said surface portion of said support and having a second edge securely received in a selected one of said predetermined plurality of slots disposed in said outer surface of said hub, whereby said at least one partition is extending upwardly from said surface portion of said support.

4. The device, according to claim 3, wherein said at least one partition further includes an upper edge thereof having a first edge portion disposed adjacent said second edge of said least one partition, said first edge portion being disposed generally horizontal when said device is in use, said upper edge further having a second edge portion inclined downwardly at an angle toward said peripheral edge of said surface portion, whereby said at least one partition having a varying height defined by said second edge portion.

5. The device, according to claim 1, wherein said partition retaining means includes a predetermined plurality of first slots disposed in a predetermined pattern in an outer surface of said hub and a predetermined plurality of second slots disposed in said second peripheral flange, each aligned with a respective one of said predetermined plurality of first slots disposed in said outer surface of said hub and engaging a third edge of said at least one partition, wherein a height of said third edge is greater than a height of said second peripheral flange.

6. The device, according to claim 1, wherein said surface portion of said support is disposed at a predetermined angle about said peripheral edge of said support.

7. The device, according to claim 1, wherein the predetermined shape of said surface portion of said support is generally round.

8. The device, according to claim 1, wherein a material of at least said support is selected from a group consisting of plastic, metal, wood and paper.

9. The device, according to claim 8, wherein said material of at least said support is said plastic.

10. The device, according to claim 1, wherein at least said support has a predetermined color.

11. The device, according to claim 1, wherein said device further includes means disposed therein for securely stacking at least a pair of said supports.

12. The device, according to claim 11, wherein said stacking means is a lid member engageable with one of said pivot, said at least one partition, said hub and various combinations thereof, said lid member having an aperture engageable with a protruding end of said pivot and, wherein said peripheral flange abutingly engages an outer edge of said lid member during stacking at least said pair of said supports.

13. The device, according to claim 1, wherein said device is employed for storing shoes of various sizes.

* * * * *